US009526362B2

(12) United States Patent
Wang

(10) Patent No.: US 9,526,362 B2
(45) Date of Patent: Dec. 27, 2016

(54) LID STRUCTURE OF DISPOSABLE BEVERAGE CUP

(71) Applicant: Kuo Tung Wang, Taichung (TW)

(72) Inventor: Kuo Tung Wang, Taichung (TW)

( * ) Notice: Subject to any disclaimer, the term of this patent is extended or adjusted under 35 U.S.C. 154(b) by 25 days.

(21) Appl. No.: 14/664,737

(22) Filed: Mar. 20, 2015

(65) Prior Publication Data

US 2016/0270571 A1 Sep. 22, 2016

(51) Int. Cl.
*B65D 51/00* (2006.01)
*A47G 19/22* (2006.01)
*B65D 43/06* (2006.01)

(52) U.S. Cl.
CPC ..... *A47G 19/2272* (2013.01); *B65D 43/06* (2013.01); *B65D 51/005* (2013.01)

(58) Field of Classification Search
CPC .... A47G 19/2272; B65D 43/06; B65D 51/005
USPC ..... 220/287, 780, 315, 796, 378, 795, 304,220/213, 232, 784, 786
See application file for complete search history.

(56) References Cited

U.S. PATENT DOCUMENTS 5,361,928 A * 11/1994 Stolzman ..... B65D 43/0218 220/320
8,118,187 B2 * 2/2012 D'Amato ..... B65D 43/0212 220/324
2008/0169287 A1 * 7/2008 Auer ..... B65D 43/0212 220/287
2016/0052679 A1 * 2/2016 Rudy ..... B65D 41/16 220/287

* cited by examiner

*Primary Examiner* — Robert J Hicks
*Assistant Examiner* — Kareen Thomas
(74) *Attorney, Agent, or Firm* — Guice Patents PLLC

(57) ABSTRACT

The invention relates to a lid structure of disposable beverage cups, a buckle portion is set on a lid rim of the lid, an inner containing groove is set on the buckle portion for the rim flange being buckled and placed inside, wherein, at least an elastic gap is set on the lid rim of the lid, two sides of the elastic gap has a moderate separated elasticity so as to combine with beverage cups manufactured by different manufacturers.

8 Claims, 6 Drawing Sheets

LID STRUCTURE OF DISPOSABLE BEVERAGE CUP

BACKGROUND OF THE INVENTION a) Field of the Invention

The invention relates to a lid structure of disposable beverage cups and, more particularly, a lid structure of disposable beverage cups available to combine with beverage cups manufactured by different manufacturers, by an elastic gap set on a lid rim of the lid, the lid rim has a moderate separated elasticity so as to achieve the purpose of combining with beverage cups manufactured by different manufacturers.

b) Description of the Prior Art

Since the population of coffee and bubble drink, a beverage cup 2 for carrying drinks, such as a paper cup and a convenient cup, and a combined lids 1 (as shown in FIG. 1) are widely extensive use. The structure is mainly that a concave space 11 set on an inner side of the lid 1 and a buckle portion 12 set on a lid rim 121 of the lid 1. An inner containing groove 123 is set on the buckle portion 12, a first buckle rim 122 and a second buckle rim 124 are set on two sides of the inner containing groove 123 respectively, and a rim flange 21 is set on a rim 20 of the beverage cup 2. When the lid 1 is covered on the beverage cup 2, the rim flange 21 is buckled and placed inside the inner containing groove 123 and clamped by the first buckle rim 122 and the second buckle rim 124 to form a close leak-proof structure.

Drink leaks frequently in use of the above lid structure combined, the reason is mainly because manufacturers of the beverage cup 2 and the lid 1 are usually different. Although the caliber of the rim 20 of the beverage cups 2 are same size, tolerances set by different manufacturers may not be the same. Thus, it is widely criticized that drink leaks frequently when combining the beverage cup 2 and the lid 1 manufactured by different manufacturers.

SUMMARY OF THE INVENTION

In view of this, the inventor finally completes the lid structure of the present invention after numerous improvements, namely, the object of the present invention is to provide a lid structure of disposable beverage cups available to combine with beverage cups manufactured by different manufacturers, due to an elastic gap set on a lid rim of the lid, two sides of the elastic gap has a moderate separated elasticity so as to achieve the purpose of combining with beverage cups manufactured by different manufacturers.

To achieve the above object according to the invention, a lid structure of disposable beverage cups according to the present invention, a concave space is set on an inner side of the lid, a buckle portion is set on a lid rim of the lid, the buckle portion is used to combine with a rim flange of a beverage cup, an inner containing groove is set on the buckle portion for the rim flange being buckled and placed inside, a first buckle rim and a second buckle rim are set on two sides of an inner surface of the inner containing groove respectively, wherein:

at least an elastic gap is set on the lid rim of the lid, two sides of the elastic gap has a moderate separated elasticity, so as to combine with beverage cups manufactured by different manufacturers.

The above inner containing groove, a recessed groove is concavely set on its inner surface.

The above inner containing groove, an annular leak-proof protective layer is distributed and adhered on its inner surface, the annular leak-proof protective layer is protruded from the inner surface, the annular leak-proof protective layer is set correspondingly to the location of combining the rim flange with the inner containing groove, to generate leak-proof closure for the rim flange.

The above inner containing groove, an annular leak-proof protective layer is distributed and adhered on its inner surface, the annular leak-proof protective layer is printed on the inner surface of the inner containing groove of the lid, and the leak-proof protective layer is protruded from the inner surface.

The above elastic gap, its gap width is smaller than 1 mm.

The above elastic gap, its gap depth is longitudinally extended upward through the first buckle rim from the lid rim.

DETAILED DESCRIPTION OF THE INVENTION

Figure 1:
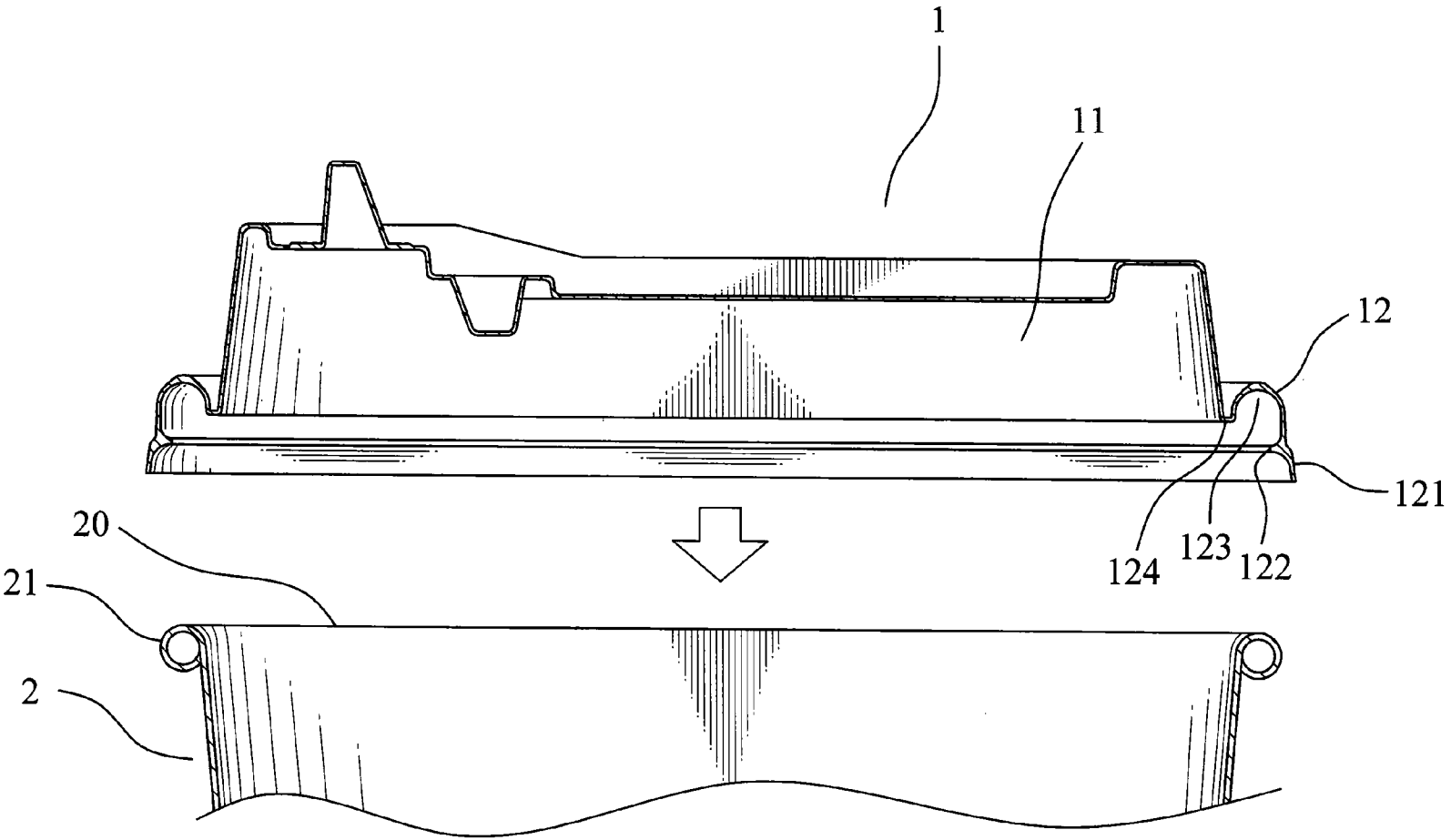
FIG. 1 PRIOR ART
FIG. 1 is a structural schematic diagram of combining a conventional lid with a beverage cup.

Please refer to FIG. 2 to FIG. 5, the lid structure of disposable beverage cups according to the present invention, a concave space 31 is set on an inner side of the lid 3, a buckle portion 32 is set on a lid rim 321 of the lid 3, the buckle portion 32 is used to combine with a rim flange 41 of a beverage cup 4, an inner containing groove 323 is set on the buckle portion 32 for the rim flange 41 being buckled and placed inside, a first buckle rim 322 and a second buckle rim 324 are set on two sides of an inner surface 320 of the inner containing groove 323 respectively, wherein:

at least an elastic gap 34 is set on the lid rim 321 of the lid 3, two sides 341, 342 of the elastic gap 34 has a moderate separated elasticity, so as to combine with beverage cups manufactured by different manufacturers.

The above inner containing groove 323, an annular leak-proof protective layer 33 is distributed and adhered on its inner surface 320, the annular leak-proof protective layer 33 is set correspondingly to the location of combining the rim flange 41 with the inner containing groove 323, to generate leak-proof closure for the rim flange 41, to thereby achieve the purpose of preventing leakage after combining the lid 3 with the beverage cup 4.

The elastic gap 34, its gap width W is smaller than 1 mm.

The elastic gap 34, its gap depth H is longitudinally extended upward through the first buckle rim 322 from the lid rim 321, but not extended to the location of the annular leak-proof protective layer 33, so that two sides 341, 342 of the elastic gap 34 has a moderate separated elasticity to combine with beverage cups manufactured by different manufacturers.

Figure 6:
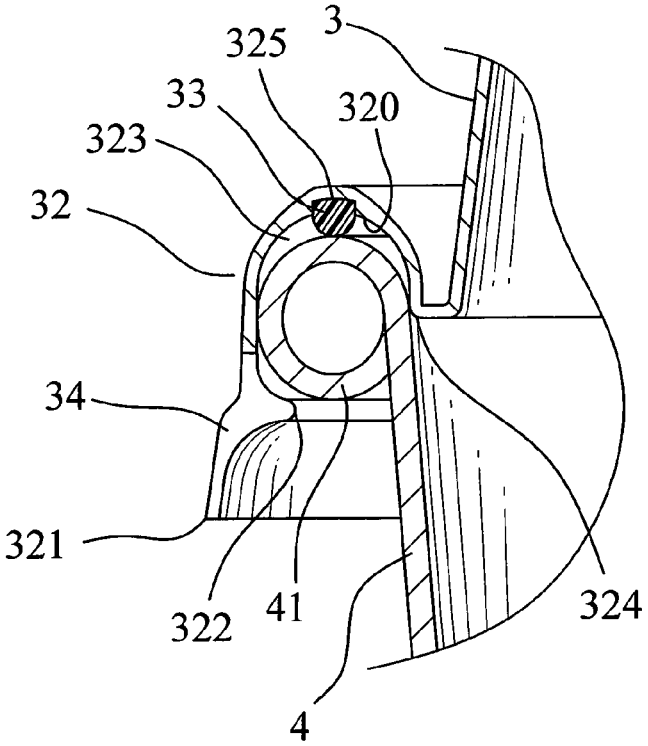
FIG. 6 is a partial schematic diagram the lid combining with a beverage cup according to an embodiment of the present invention.

As shown in FIG. 6, the above inner containing groove 323, a recessed groove 325 is concavely set on its inner surface for putting a part of the annular leak-proof protective layer 33 into the recessed groove 325, to thereby contact the inner surface 320 deeply.

The above annular leak-proof protective layer 33 is printed on the inner surface 320 of the inner containing groove 323 of the lid 3, and the leak-proof protective layer 33 is protruded from the inner surface 320.

The above annular leak-proof protective layer 33 is an elastic body for the rim flange 41 to be combined tightly.

The above annular leak-proof protective layer 33, which is consisted of non-toxic material that meets the requirements of food safety, is adhered on the inner surface 320 of the inner containing groove 323 of the lid 3.

Figure 2:
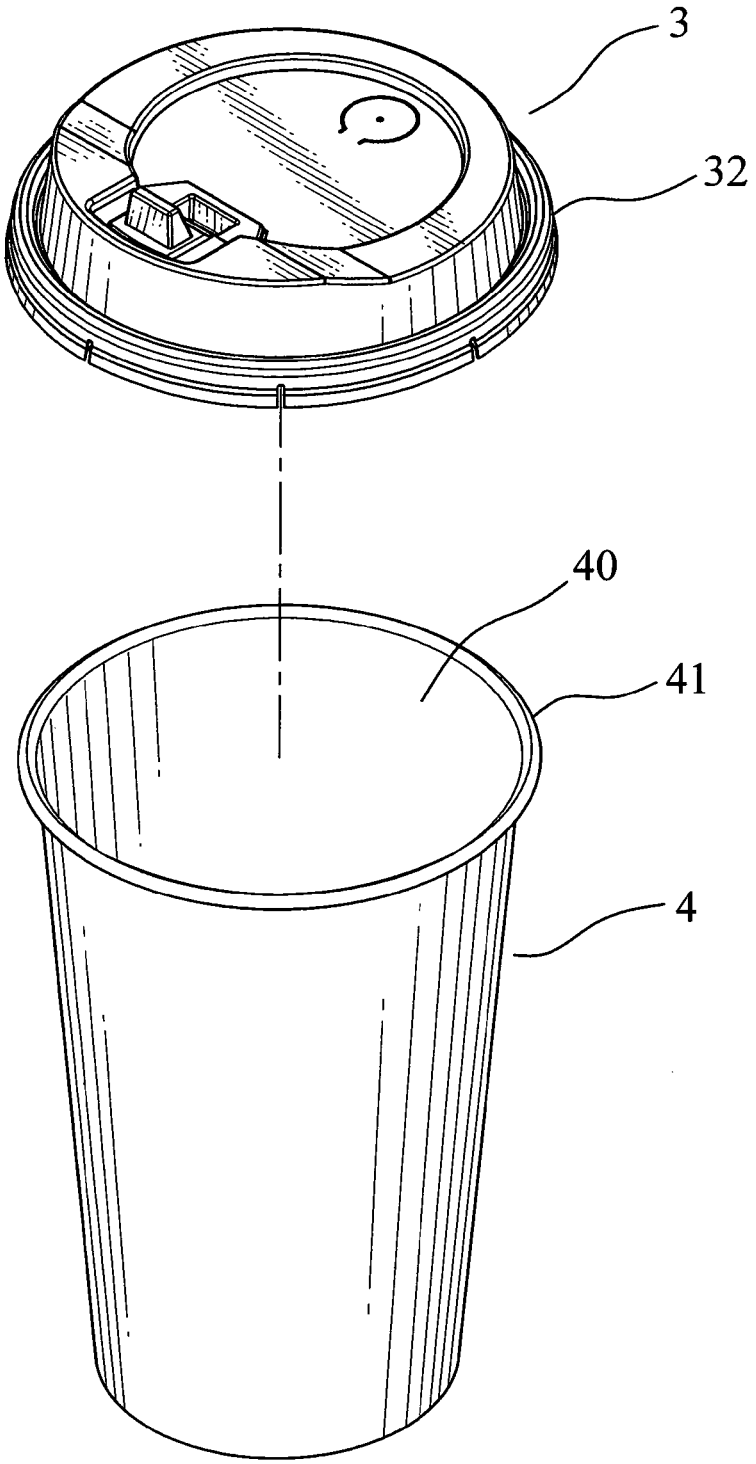
FIG. 2 is a three-dimensional schematic diagram of the lid combining with a beverage cup according to the present invention.
Figure 3:
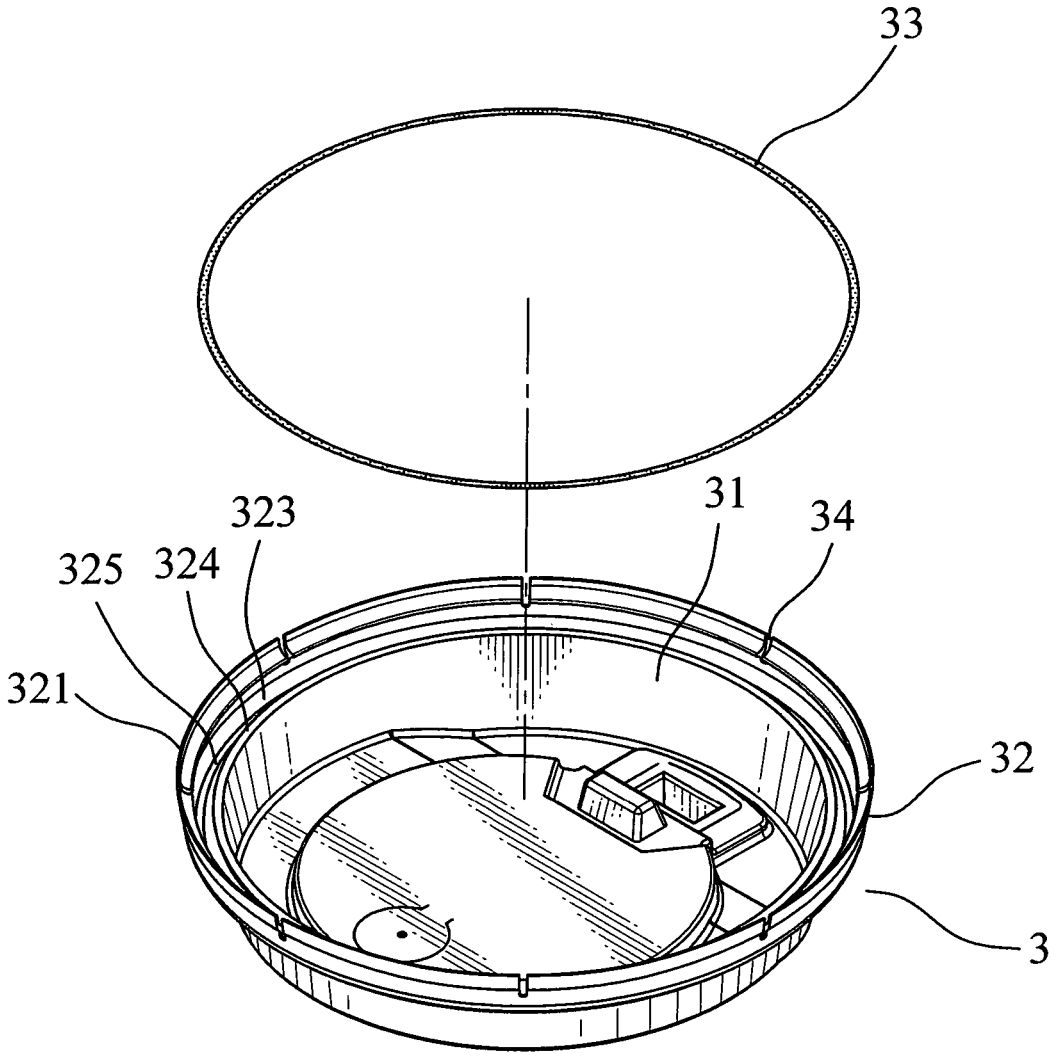
FIG. 3 is a three-dimensional exploded diagram of the lid according to the present invention.
Figure 4:
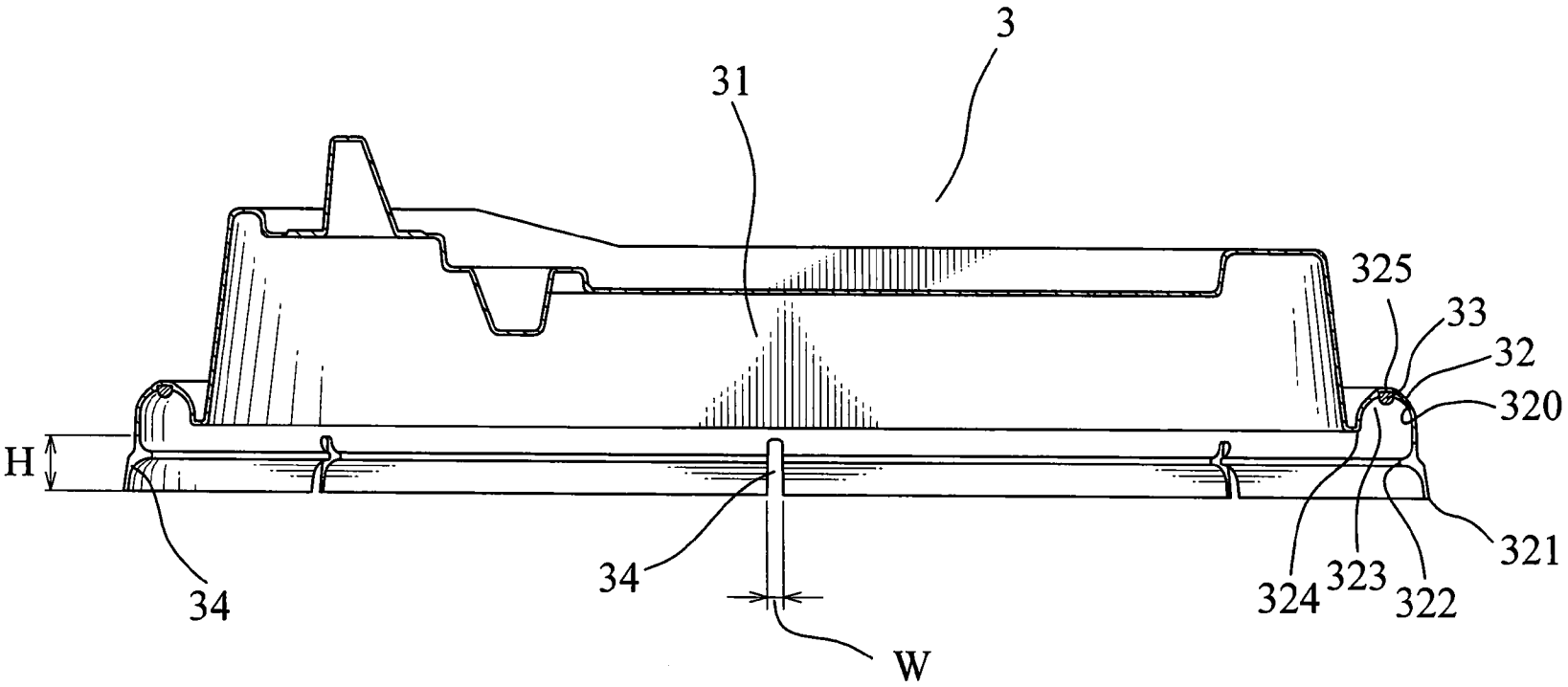
FIG. 4 is a cross-sectional schematic diagram of the lid according to the present invention.
Figure 7:
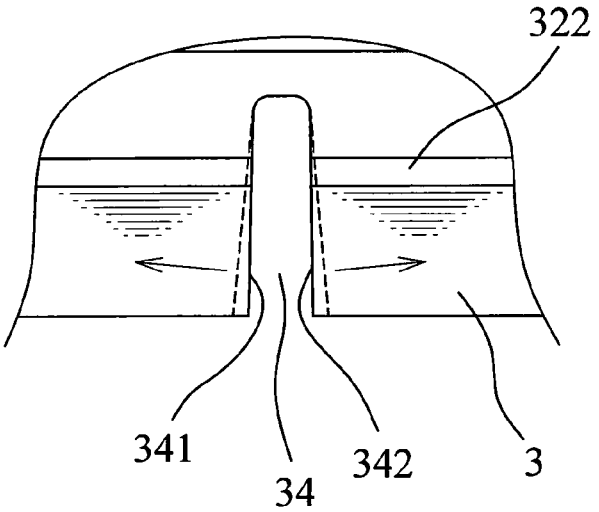
FIG. 7 is an operation diagram of setting an elastic gap on the lid according to the present invention.

Please refer to FIG. 2, FIG. 4, FIG. 7, in the present invention, in order to meet the requirements of tolerance of the rim 40 of the beverage cup 4 manufactured by each manufacturer that the lid 3 may be tightly combined with the beverage cup 4, at least an elastic gap 34 is set on the lid rim 321 of the lid 3 of the present invention, a gap width W of the elastic gap 34 is smaller than 1 mm, a gap depth H of the elastic gap 34 is longitudinally extended upward through the first buckle rim 322 from the lid rim 321, but not extended to the location of the annular leak-proof protective layer 33, so that two sides 341, 342 of the elastic gap 34 has a moderate separated elasticity to combine with beverage cups manufactured by different manufacturers.

Figure 5:
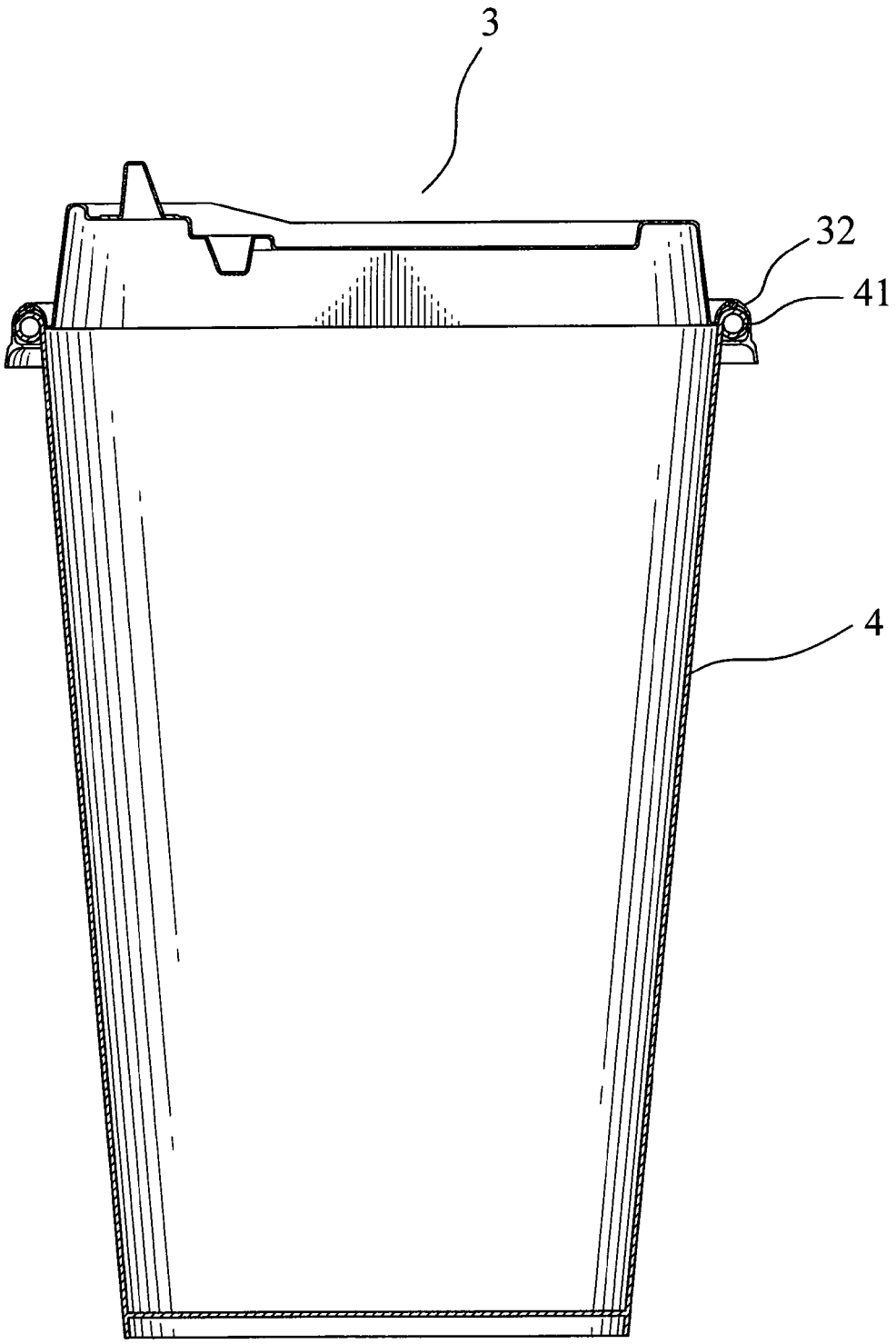
FIG. 5 is a schematic diagram of the lid combining with a beverage cup according to an embodiment of the present invention.

Please refer to FIG. 5, FIG. 6 and FIG. 7, by the structure of the lid 3 according to the present invention, after the lid and the beverage cup 4 are combined, if the tolerance of the rim 40 of the beverage cup 4 is larger than limit of combining size, through slightly moderating two sides 341, 342 of the elastic gap 34, the lid 3 of the present invention may be provided to combine with the beverage cup 4 manufactured by each manufacturer and the requirement of being combined tightly without leakage may be ensured to achieve. Besides, due to the moderate elasticity, the leak-proof protective layer 33 may be contacted more tightly to the rim flange 41, and generate leak-proof effect for the rim flange 41 at the contacted position, and a leak-proof closure structure is formed with being clamped by the first buckle rim 322 and the second buckle rim 324 to effectively avoid the situation that drinks leak after combining the lid 3 and the beverage cup 4.

What is claimed is:

1. A lid structure of disposable beverage cups, a concave space is set on an inner side of the lid, a buckle portion is set on a lid rim of the lid, the buckle portion is used to combine with a rim flange of a beverage cup, an inner containing groove is set on the buckle portion for the rim flange being buckled and placed inside, a first buckle rim and a second buckle rim are set on two sides of an inner surface of the inner containing groove respectively, wherein:

at least an elastic gap is set on the lid rim of the lid, two sides of the elastic gap has a moderate separated elasticity, so as to combine with beverage cups manufactured by different manufacturers, a gap width of the elastic gap is smaller than 1 mm.

2. The lid structure of disposable beverage cups as claimed in claim 1, wherein a recessed groove is concavely set on an inner surface of the inner containing groove.

3. The lid structure of disposable beverage cups as claimed in claim 1, wherein an annular leak-proof protective layer is distributed and adhered on an inner surface of the inner containing groove, the annular leak-proof protective layer is protruded from the inner surface, the annular leak-proof protective layer is set correspondingly to the location of combining the rim flange with the inner containing groove, to generate leak-proof closure for the rim flange.

4. The lid structure of disposable beverage cups as claimed in claim 1, wherein an annular leak-proof protective layer is distributed and adhered on an inner surface of the inner containing groove, the annular leak-proof protective layer is printed on the inner surface of the inner containing groove of the lid, and the leak-proof protective layer is protruded from the inner surface.

5. A lid structure of disposable beverage cups, a concave space is set on an inner side of the lid, a buckle portion is set on a lid rim of the lid, the buckle portion is used to combine with a rim flange of a beverage cup, an inner containing groove is set on the buckle portion for the rim flange being buckled and placed inside, a first buckle rim and a second buckle rim are set on two sides of an inner surface of the inner containing groove respectively, wherein:

at least an elastic gap is set on the lid rim of the lid, two sides of the elastic gap has a moderate separated elasticity, so as to combine with beverage cups manufactured by different manufacturers, a gap depth (H) of the elastic gap is longitudinally extended upward through the first buckle rim from the lid rim.

6. The lid structure of disposable beverage cups as claimed in claim 5, wherein a recessed groove is concavely set on an inner surface of the inner containing groove.

7. The lid structure of disposable beverage cups as claimed in claim 5, wherein an annular leak-proof protective layer is distributed and adhered on an inner surface of the inner containing groove, the annular leak-proof protective layer is protruded from the inner surface, the annular leak-proof protective layer is set correspondingly to the location of combining the rim flange with the inner containing groove, to generate leak-proof closure for the rim flange.

8. The lid structure of disposable beverage cups as claimed in claim 5, wherein an annular leak-proof protective layer is distributed and adhered on an inner surface of the inner containing groove, the annular leak-proof protective layer is printed on the inner surface of the inner containing groove of the lid, and the leak-proof protective layer is protruded from the inner surface.

* * * * *